US007438068B2

(12) United States Patent
Nanguneri

(10) Patent No.: US 7,438,068 B2
(45) Date of Patent: Oct. 21, 2008

(54) INTERACTIVE DEVICE FOR PROCESS EXCELLENCE TRAINING

(76) Inventor: Srikanth R. Nanguneri, 3313 Geneva Dr., Santa Clara, CA (US) 95051

( * ) Notice: Subject to any disclaimer, the term of this patent is extended or adjusted under 35 U.S.C. 154(b) by 0 days.

(21) Appl. No.: 11/070,972

(22) Filed: Mar. 2, 2005

(65) Prior Publication Data

US 2005/0279339 A1 Dec. 22, 2005

Related U.S. Application Data

(60) Provisional application No. 60/549,592, filed on Mar. 2, 2004.

(51) Int. Cl.
*F41B 3/00* (2006.01)

(52) U.S. Cl. ..... 124/16; 124/7; 124/17; 124/36

(58) Field of Classification Search ..... 124/7, 124/16, 17, 36
See application file for complete search history.

(56) References Cited

U.S. PATENT DOCUMENTS

| | | | | |
|---|---|---|---|---|
| 4,111,179 | A * | 9/1978 | Hashimoto | 124/7 |
| 4,327,913 | A * | 5/1982 | Bock | 273/317.7 |
| 4,860,717 | A * | 8/1989 | Powell et al. | 124/7 |
| 6,182,648 | B1 * | 2/2001 | Lundgren | 124/7 |
| 6,343,597 | B1 * | 2/2002 | Spikes | 124/7 |

OTHER PUBLICATIONS

Website pages: http://www.statapult.com, "The NCMR Statapult", NCMR Company LLC Statapults, printed on Nov. 18, 2003 (3 pages).

Website pages: http://www.launsby.com/Tools.asp, "The Statapult", Launsby Consulting-design of experiments training tools, printed on Nov. 18, 2003 (2 pages).

* cited by examiner

*Primary Examiner*—John Ricci
(74) *Attorney, Agent, or Firm*—Richard E. Oney; Tiffany & Bosco, P.A.

(57) ABSTRACT

An interactive catapult training device is provided for teaching and demonstrating the principles of problem solving using tools and techniques of applied statistics, Six Sigma, lean manufacturing and other process excellence techniques. The device includes a base and a hub fixed to a position with respect to the base and removable from the base. A swing arm is coupled to and rotatable about the hub from a first angle to a second angle, the swing arm being removable from the hub. A cup is fixed to a position with respect to the swing arm and adapted to receive a projectile, the cup being removable from the swing arm. A spring is coupled between a first coupling point fixed with respect to the base and a second coupling point on the swing arm. The spring provides tension for setting the swing arm in motion from the first angle to the second angle. The spring can be removable from the first and second coupling points. Inputs that can be varied and measured include the first coupling point, the second coupling point, the first swing arm angle, the second swing arm angle, the hub position with respect to the base and the cup position with respect to the swing arm can be varied and measured. Outputs than can be measured include the linear distance and the angle of deviation of the launched projectile as well as cycle time for launching. The input and output data can be managed electronically for online teaching and learning.

6 Claims, 13 Drawing Sheets

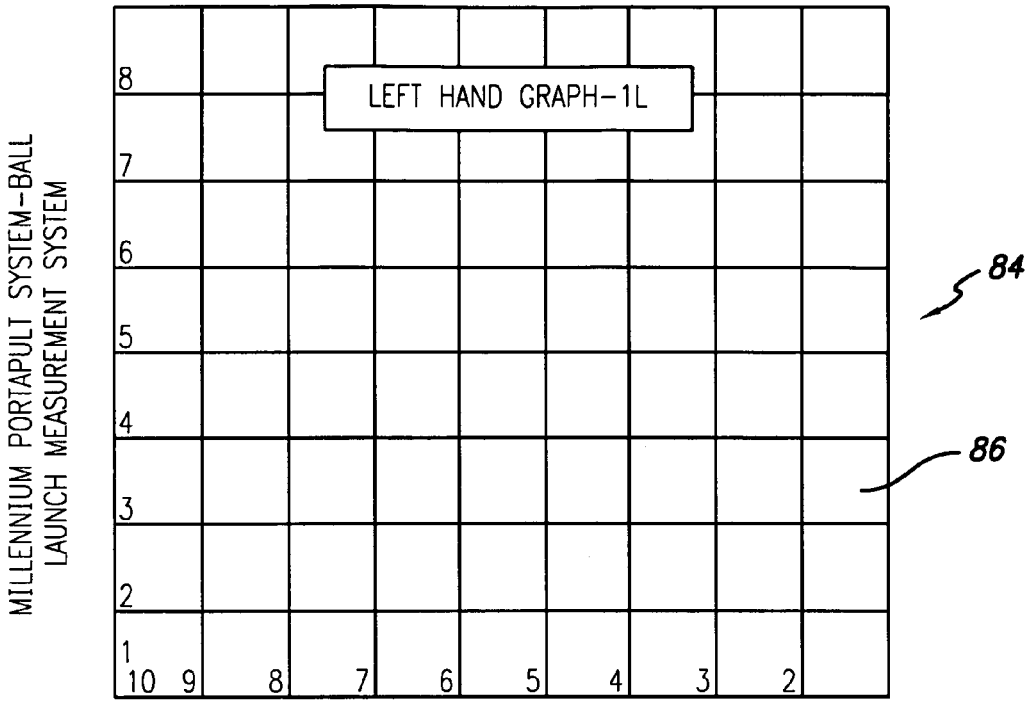
FIG. 12A
FIG. 12B
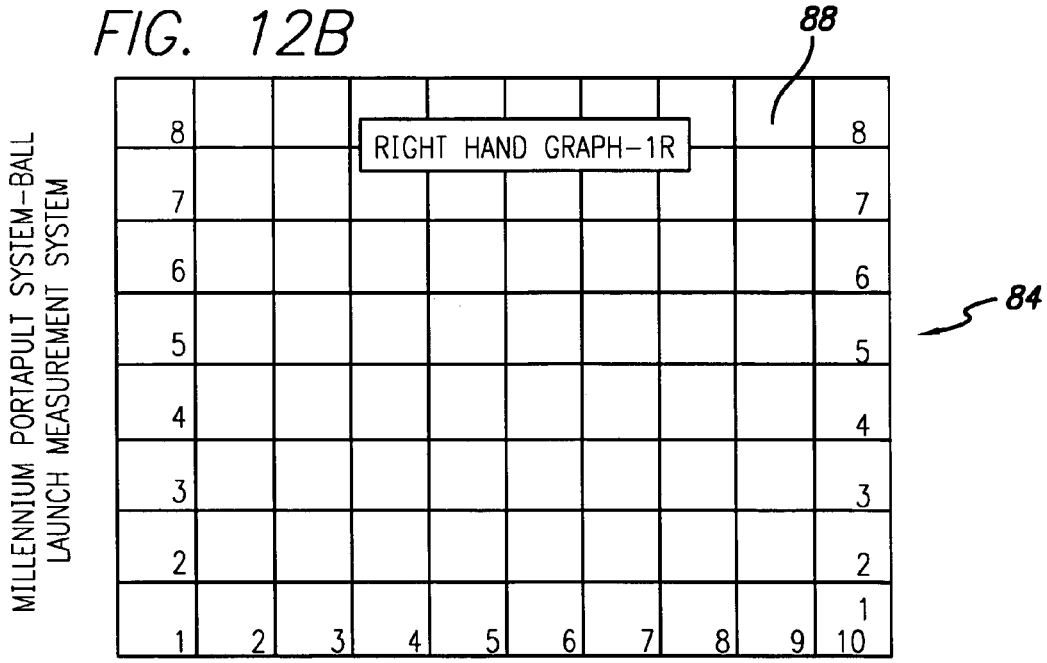

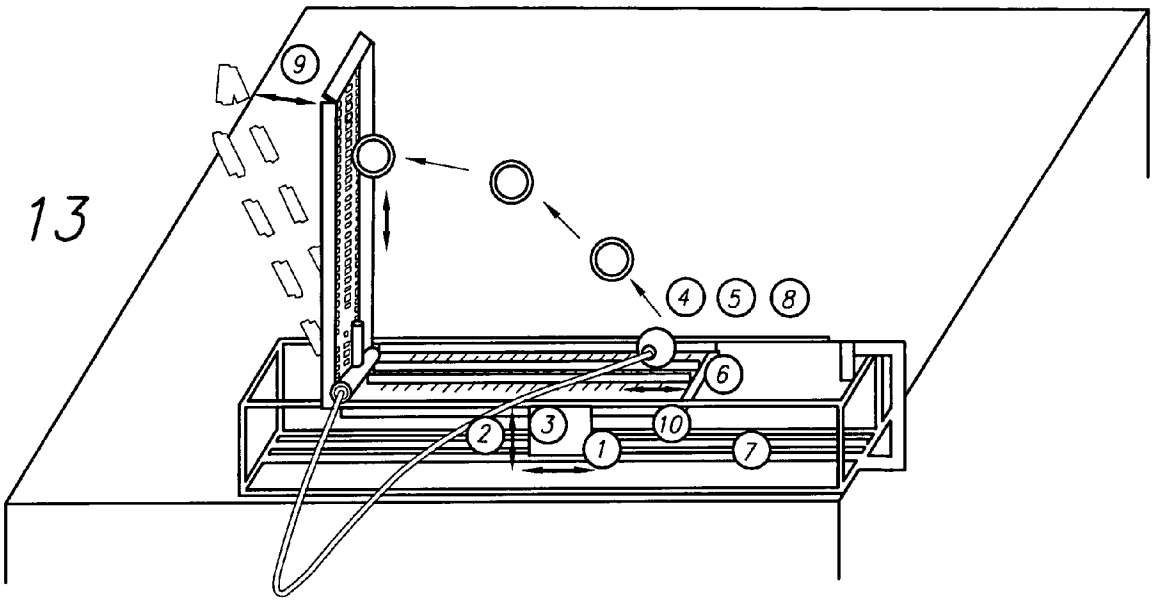

FIG. 13

POSSIBLE CONTROLLABLE FACTORS (x's)

1. HORIZONTAL POSITION OF COMPRESSION SPRING (l)
2. VERTICAL DEFLECTION OF COMPRESSION SPRING (l)
3. FORCE CONSTANT OF COMPRESSION SPRING ($m/lt^2$)
4. BALL DENSITY ($m/l^3$)
5. HORIZONTAL POSITION OF BALL CUP (l)
6. HORIZONTAL POSITION OF STOP STRING (l)
7. LENGTH OF STOP STRING (l)
8. DENSITY OF SWING ARM ($m/l^3$)
9. ANGLE OF RECEIVING ARM (°)
10. LENGTH OF SWING ARM (l)

POSSIBLE DESIRED OUTPUTS (Y's)

- $Y_1$ HEIGHT OF STRIKE (l)
- $Y_2$ SPEED/SHOT (#/t)
- $Y_3$ TIME INVESTED (% x's)

- l (LENGTH OF UNITS)
- m (MASS UNITS)
- t (TIME UNITS)
- ° (ANGLE UNITS)

INTERACTIVE DEVICE FOR PROCESS EXCELLENCE TRAINING

RELATED APPLICATION DATA

This application is based on and claims the benefit of U.S. Provisional Patent Application No. 60/549,592 filed on Mar. 2, 2004, the disclosure of which is incorporated herein by this reference.

BACKGROUND

This invention relates to training devices and methods. More particularly, it relates to a device and method for use in teaching and demonstrating the principles and techniques of problem solving based on statistical concepts, Six Sigma, and lean manufacturing.

In conventional training for statistical, Six Sigma, lean manufacturing, and other process excellence applications, training devices previously have been used. Such devices have included small catapults designed to provide an output (i.e., the launching of a ball), which varies in response to certain inputs that can be varied (e.g, variable mechanical characteristics of the catapult).

These previously known devices, however, have suffered from a number of shortcomings. For example, they have been limited in setting input variables. Previously known devices do not offer the instructor the flexibility to vary inputs using a combination of discrete, continuous, FPI (foot-pound-inches) and SI (International System) units of measurement. Additionally, prior devices lack features and flexibility to demonstrate in a classroom environment or in the field how improvements in a design or process can be made. Also, in previous designs, output data collection is based on visual observation of the user and is susceptible to manual error. Retrieval of a launched ball, which is the output of the device, is inconvenient. Also, previously known devices are susceptible to damage and premature breakage, which requires significant repair efforts or even replacement of an entire unit. Typically, these devices have been manufactured from wood. This material can be severely affected by operational environment factors. A broken part calls for the replacement of an entire unit, making it expensive to repair or maintain. Previously known devices also use rubber bands to generate the force to launch balls, which are likely to relax, fail or wear without any prior warning. This will seriously impact the results of the operation by infecting the mathematical model between the input and output variables. In addition, previously known devices are inconvenient to store and transport. Moreover, as investment in training dollars have decreased, self-training has become desirable. Previously known devices, however, are inadequate to address this need.

There is a need, therefore, for an improved device and method for providing training for statistical, Six Sigma, lean manufacturing, and other process excellence applications. It is an object of the present invention to provide in improved training device and method that satisfies this need and that is easy to use.

Another object of the present invention is to provide a training device that is lightweight and portable and that can be readily disassembled for ease of packaging.

Yet another object of the present invention is to provide a training device that is relatively easy to manufacture, durable and that can be easily and inexpensively repaired without having to replace the entire device.

Still another object of the present invention is to provide a training device that is flexible enough to be used to train students of different skill levels such as beginner, intermediate and advanced.

Another objective of the present invention is to provide a training device with which a user can interactively exchange information electronically, thereby eliminating the probability of error in manual data transmission, saving time and money in training efforts and providing a device that can be used for online training sessions.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided an improved training system and for teaching and demonstrating the principles of problem solving using tools and techniques of applied statistics, Six Sigma, lean manufacturing and other process excellence techniques. A training system according to the present invention includes an interactive catapult training device. The device includes a base and a hub fixed to a position with respect to the base and removable from the base. A swing arm is coupled to and rotatable about the hub from a first angle to a second angle, the swing arm being removable from the hub. A cup is fixed to a position with respect to the swing arm and adapted to receive a projectile, the cup being removable from the swing arm. A spring is coupled between a first coupling point fixed with respect to the base and a second coupling point on the swing arm. The spring provides tension for setting the swing arm in motion from the first angle to the second angle. The spring can be removable from the first and second coupling points. The device preferably also includes means for varying and measuring each of the first coupling point, the second coupling point, the first swing arm angle, the second swing arm angle, the hub position with respect to the base and the cup position with respect to the swing arm.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred methods and embodiments given below, serve to explain the principles of the invention.

FIGS. 12*a* and 12*b* show graph sheets of a graphical measurement system according to the invention, which can be used to characterize the output of the training device as either linear distance of launch or angle of deviation of launch from the launch center line.

FIG. 13 is a perspective view of still another embodiment of a training device according to the present invention, which utilizes a tethered ball that is easily retrievable.

DESCRIPTION

Although preferred embodiments and methods of the invention are described in the following description and illustrated in the accompanying drawings, it will be understood that the invention is not limited to the drawings disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the invention.

The present invention provides an improved training system for characterizing and optimizing a process output variable as a function of the process input variables to help the user comprehend how businesses today can reduce their internal cost of operation and grow their top line of sales for overall profitability.

Figure 1:
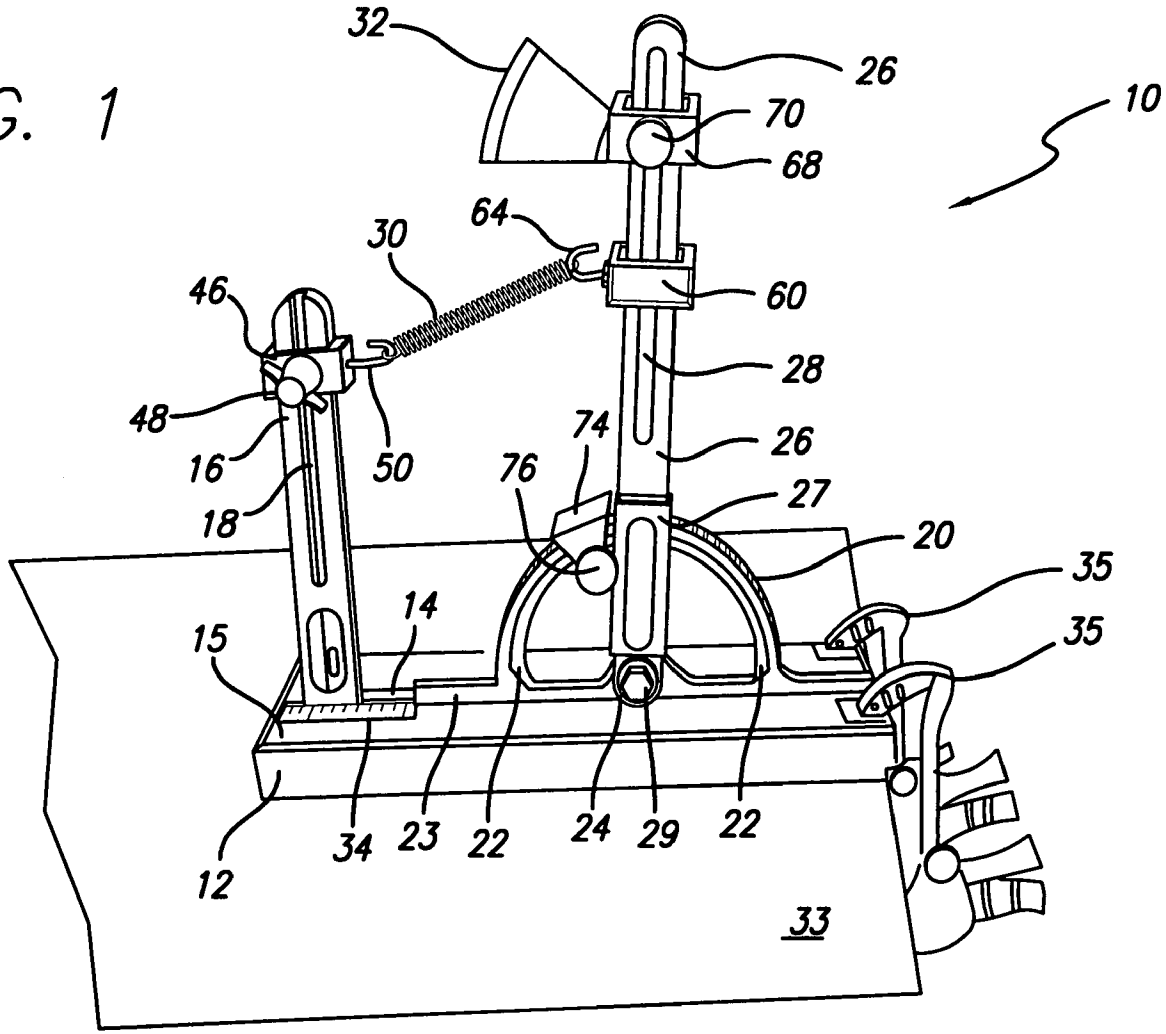
FIG. 1 is a perspective view of one embodiment of a catapult training device according to the present invention showing the device assembled and clamped to a table top for operation.

Referring to FIG. 1, a preferred embodiment of the system according to my invention includes a catapult device 10 that can be used to launch a projectile such as a ball at a distance that can be predicted based on input settings of the catapult device 10. FIG. 1 shows the device 10 assembled and clamped to a table top for operation. The device 10 includes a base 12 having a slotted track 14 formed in its upper surface 15, a linear arm 16 having a slotted track 18 formed in one side along a portion of its length, a semicircular annular arch 20 having a raised track 22 along its inner edge, a base 23 and an inner hub 24, and an angular swing arm 26 having one end rotationally mounted to the hub 24 so that the swing arm 26 can swing along the arch 20. The arch base 23 fits within the base slotted track 14. The swing arm 26 also has a slotted track 28 formed along a portion of its length. A tension spring 30 is coupled between the linear arm 16 and the swing arm 26. A ball cup 32 is mounted to the swing arm 26 for holding a projectile, which preferably is a magnetized or metal-coated plastic ball. In operation, the training device 10 is clamped to a surface such as a table top 33 using one or more C- clamps 35, which hold the base 12 tightly in place to prevent movement from the operation impact and vibration of the swing arm 26.

Figure 3:
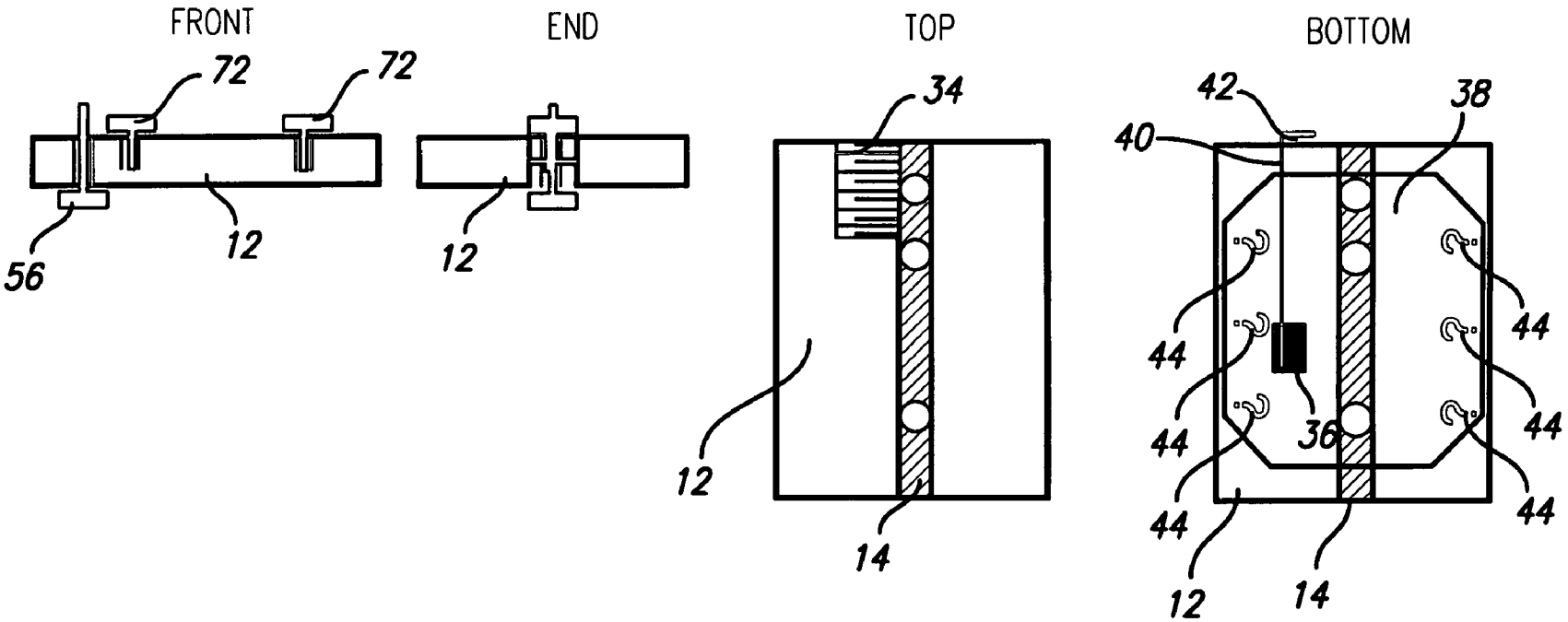
FIG. 3 shows front, end, top and bottom facing views of the base of the training device of FIG. 1.

Referring to FIG. 3, the base of the training device is shown in more detail. Disposed on the base top surface 15 is a linear scale 34. The linear scale 34 is aligned with the slotted track 14 to measure the position of the annular arch with respect to the linear arm 16. The linear scale 34 can be removably mounted into a recess or grooved track in the base top surface, which allows for the option of using different versions of the scale (i.e., versions having FPI units of measurement, SI units of measure or discrete versus continuous increments). In one preferred embodiment, the linear scale 34 can be a laminate film made out of a plastic that has flexibility, durability and resistance to moisture and other environmental substances.

Integrated into the device base 12 is a self-retracting measuring tape 36. In a preferred embodiment, the measuring tape can be mounted in a recess 38 formed in the bottom surface of the base 12. The measuring tape 36 is aligned so that the tape 40 extends parallel to the base slotted track 14. A lip 42 disposed at the end of the tape of the arch extends beyond the edge of the base 12 and is held against the base by the spring tension of the self-retracing measuring tape. In this configuration, the measuring tape 36 can be used to measure the distance that a ball is launched by the training device 10. Integration of the measuring tape into the base 12 in this manner advantageously avoids having to provide a separate measuring tape which would have to be carried separately and is likely to be misplaced. The base recess 38 also can have hooks 44 mounted within it for storing one or more spring 30, such as during transportation or packaging.

Figure 4:
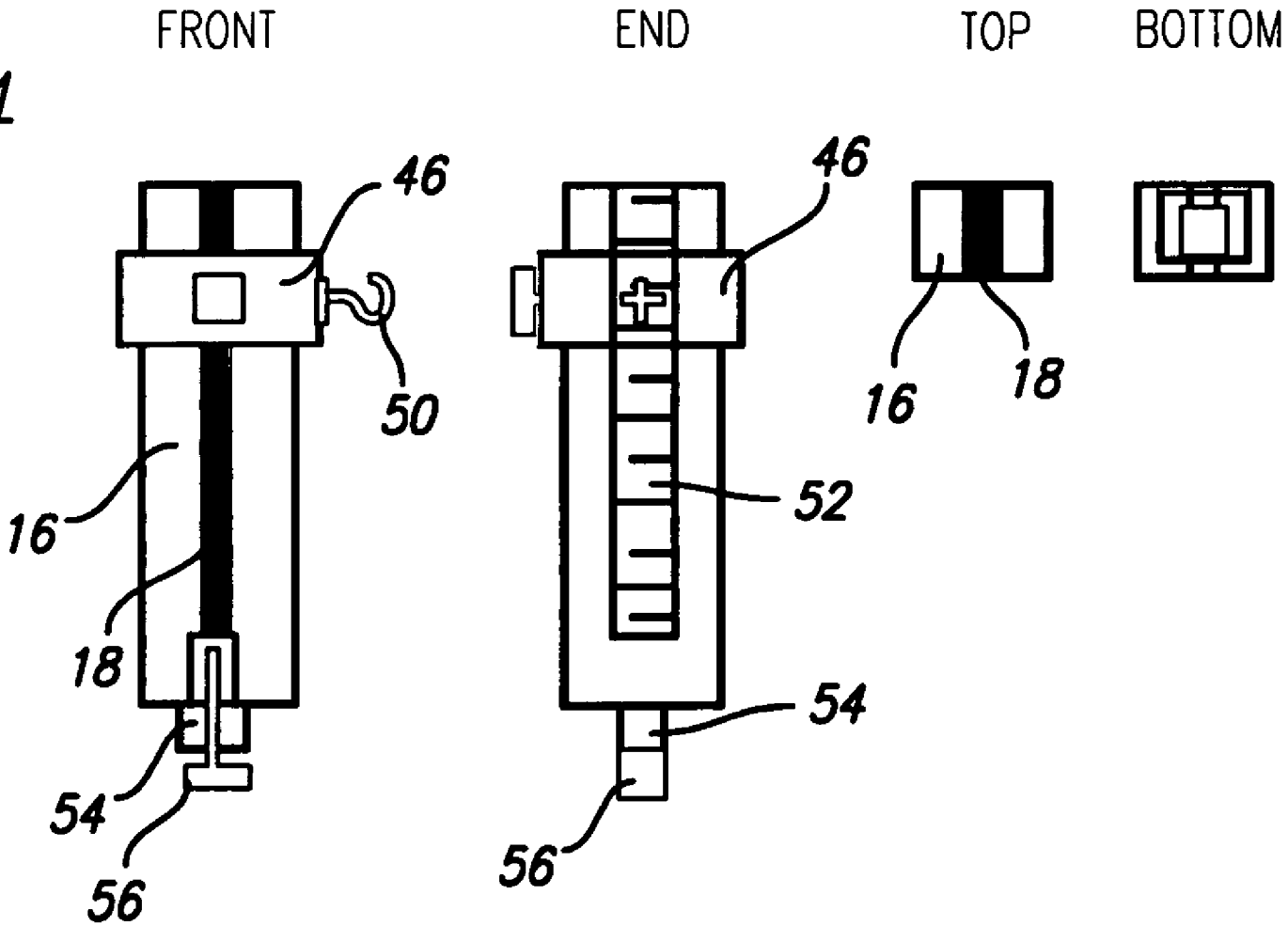
FIG. 4 shows front, end, top and bottom facing views of the linear arm of the training device of FIG. 1.
Figure 8:
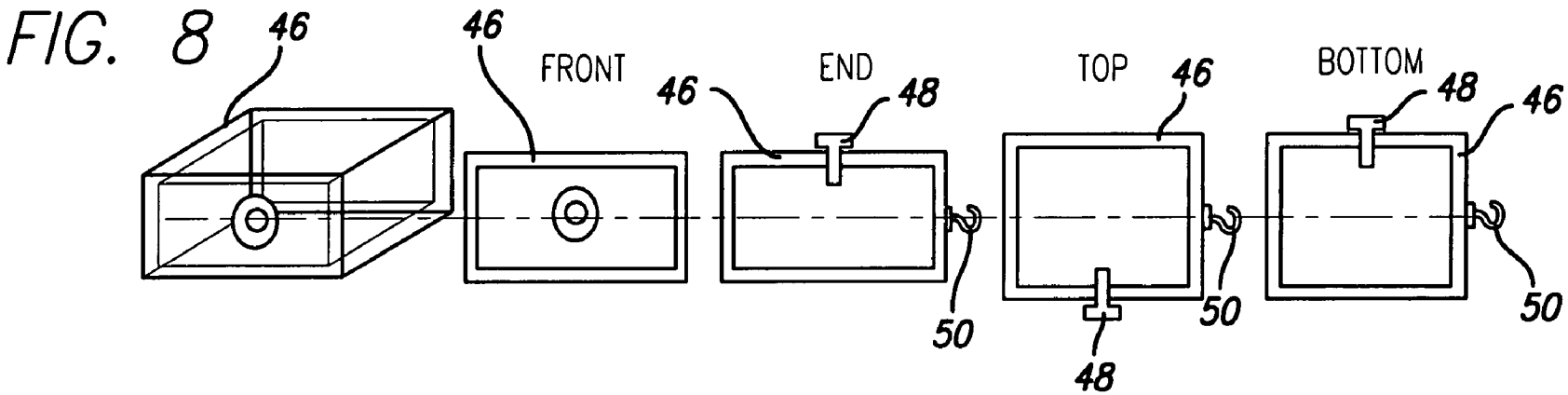
FIG. 8 shows front, end, top and bottom facing views of the arm brackets of the training device of FIG. 1.

Referring to FIG. 4, the linear arm 16 of the training device is shown in more detail. As previously described, the slotted track 18 is formed in one side of the linear arm 16 along a portion of its length. An arm bracket 46 fits over the top of the linear arm 16 and can be slidably moved along the arm's length. The arm bracket 46 is held in place on the arm 16 by a set screw 48 which extends into the slotted track 18 and can be screwed down to engage and lock against the bottom of the slotted track 18. FIG. 8 shows the arm bracket in more detail. Mounted to the arm bracket 46 is a hook 50 for holding an end of the tension spring 30. Positioned on the side of the linear arm 16 opposite the slotted track 18 is a linear scale 52, which is similar in design to the linear scale 34 previously described, except that arm linear scale 34 is longer to accommodate the length of the linear arm. At the bottom of the linear arm 34 is a tab 54, which is sized to fit closely into the base slotted track 14. When assembled (see FIG. 1), the linear arm 16 is slidably mounted to the base 12 by inserting the linear arm tab 54 into the base slotted track 14. The linear arm 16 is held in place by a clamping screw 56 inserted through the base 12 into the bottom of the linear arm 16 until the head of the clamping screw 56 locks against base 12. In this configuration, the mounted position of the linear arm 16 can be continuously varied along the base slotted track 14, thereby providing a variable input for the catapult device 10, which variable input can be measured by the base linear scale 34. Also, the mounted position of the arm bracket 46 can be can be continuously varied along the linear arm slotted track 18, thereby providing another variable input for the catapult device 10, which variable input can be measured by the arm linear scale 34. An adjustment for adjusting the height of the linear arm 16 with respect to the base 12 can provide still another variable input. This can be achieved by providing one or more a height adjustment screws in the base of the linear arm 16 that can be raised or lowered to set the height of the linear arm 16 to the desired level. Appropriate linear scales to measure this height adjustment can be incorporated. Because the tension spring 30 can be removed and replaced, tension springs having different tensions can be used, thereby providing another variable input to the device.

The tension spring 30 provides the required force for setting the swing arm 26 in motion to launch a ball. Using the spring 30 rather than a rubber band, such as has been used in previous devices, provides a number of advantages. One advantage is that the spring component allows for non-destructive testing and calibration via characterization prior to its use. The spring can be characterized using a tension meter to determine the effect of wear and tear if any. This is impossible with the prior art devices using rubber bands, as testing the rubber band will change its elasticity significantly unless destructive testing is employed at a significant cost in time and money. It will be understood that the tension spring 30 can be implemented using any suitable spring mechanism for providing the necessary spring action to launch a ball from the device.

Figure 5:
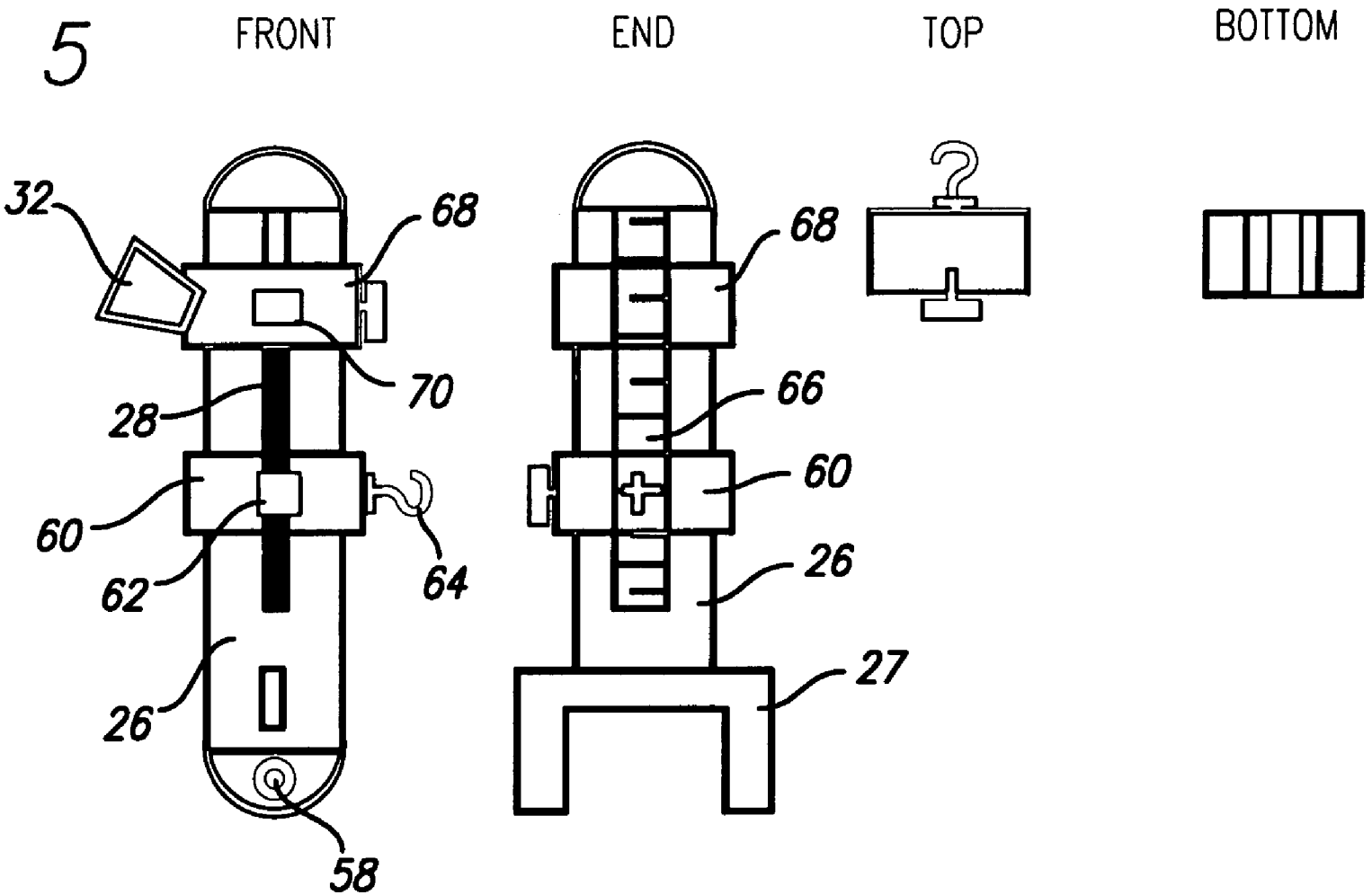
FIG. 5 shows front, end, top and bottom facing views of the swing arm of the training device of FIG. 1.

Referring to FIG. 5, the angular swing arm 26 of the training of the training device is shown in more detail. At one end of the swing arm 26 is a fork 27 for mounting the swing arm 26 to the arch hub 24. The swing arm fork 27 fits over the annular arch 20 and arch hub 24 and is rotatably mounted to the hub 24 using a hub bolt 29 secured with a washer and nut so that the swing arm 26 can pivot about the hub 24 and swing freely along the arch 20. A swing arm bracket 60 fits over the top of the swing arm 26 and can be slidably moved along the arm's length. The arm bracket 60 is held in place on the swing arm 26 by a set screw 62 which extends into the swing arm slotted track 28 and can be screwed down to engage and lock against the bottom of the swing arm slotted track 28. Mounted to the swing arm bracket 60 is a hook 64 for holding an end of the tension spring 30. Positioned on the side of the swing arm 26 opposite the slotted track 28 is a linear scale 66, which is similar in design to the linear arm scale 52 previously described. A ball cup bracket 68 also fits over the top of the swing arm 26 and can be slidably moved along the arm's length. The ball cup bracket 68 also is held in place on the swing arm 26 by a set screw 70 which extends into the swing arm slotted track 28 and can be screwed down to engage and lock against the bottom of the swing arm slotted track 28. In this configuration, the mounted position of each of the swing arm bracket 60 and the ball cup bracket 68 can be can be continuously varied along the swing arm slotted track 28, thereby providing additional variable inputs for the catapult device 10, which variable inputs can be measured by the swing arm scale 66.

Figure 9:
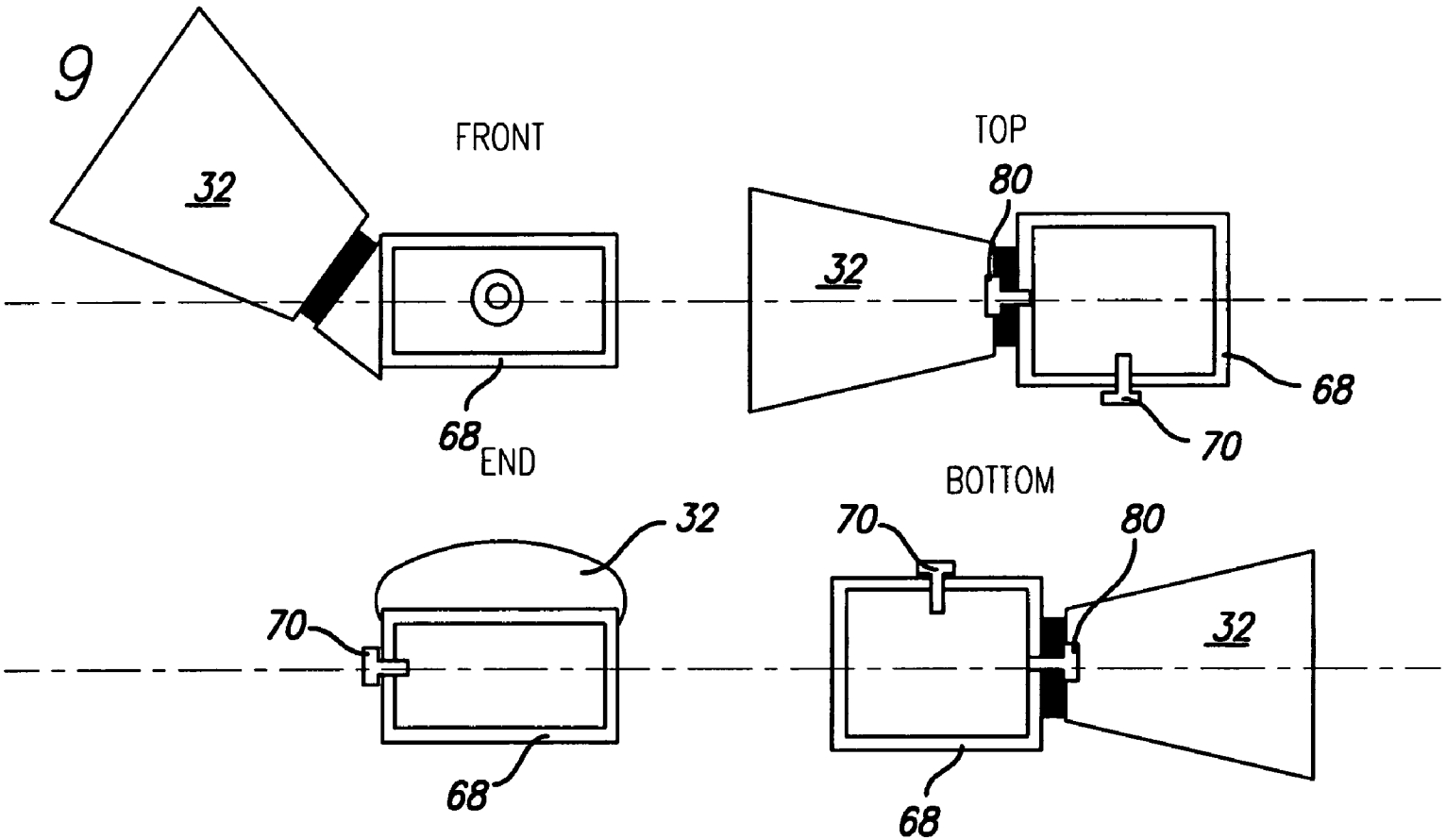
FIG. 9 shows front, end, top and bottom facing views of the ball cup of the training device of FIG. 1.

FIG. 9 shows the ball cup bracket 68 in more detail. Preferably, the ball cup 32 is a truncated cone and serves to hold the ball in place by being positioned at an angle to prevent the ball from falling out due to gravitational force. The ball cup 32 can be mounted to the ball cup bracket 68 using any suitable means. In one preferred embodiment, the ball cup 32 is mounted to the ball cup bracket 68 by a mounting screw 80 inserted through the bottom of the ball cup 32 and into a threaded hole in the ball cup bracket 68. In another preferred embodiment, the ball cup 32 can be attached to the ball cup bracket 68 in such a fashion that the ball cup 32 can be rotated and tightened so that the angle of the ball cup 32 with respect to the ball cup bracket 68 can be varied and still remain stable during the operation of the swing arm 26, thereby providing another variable input to the device.

Figure 6:
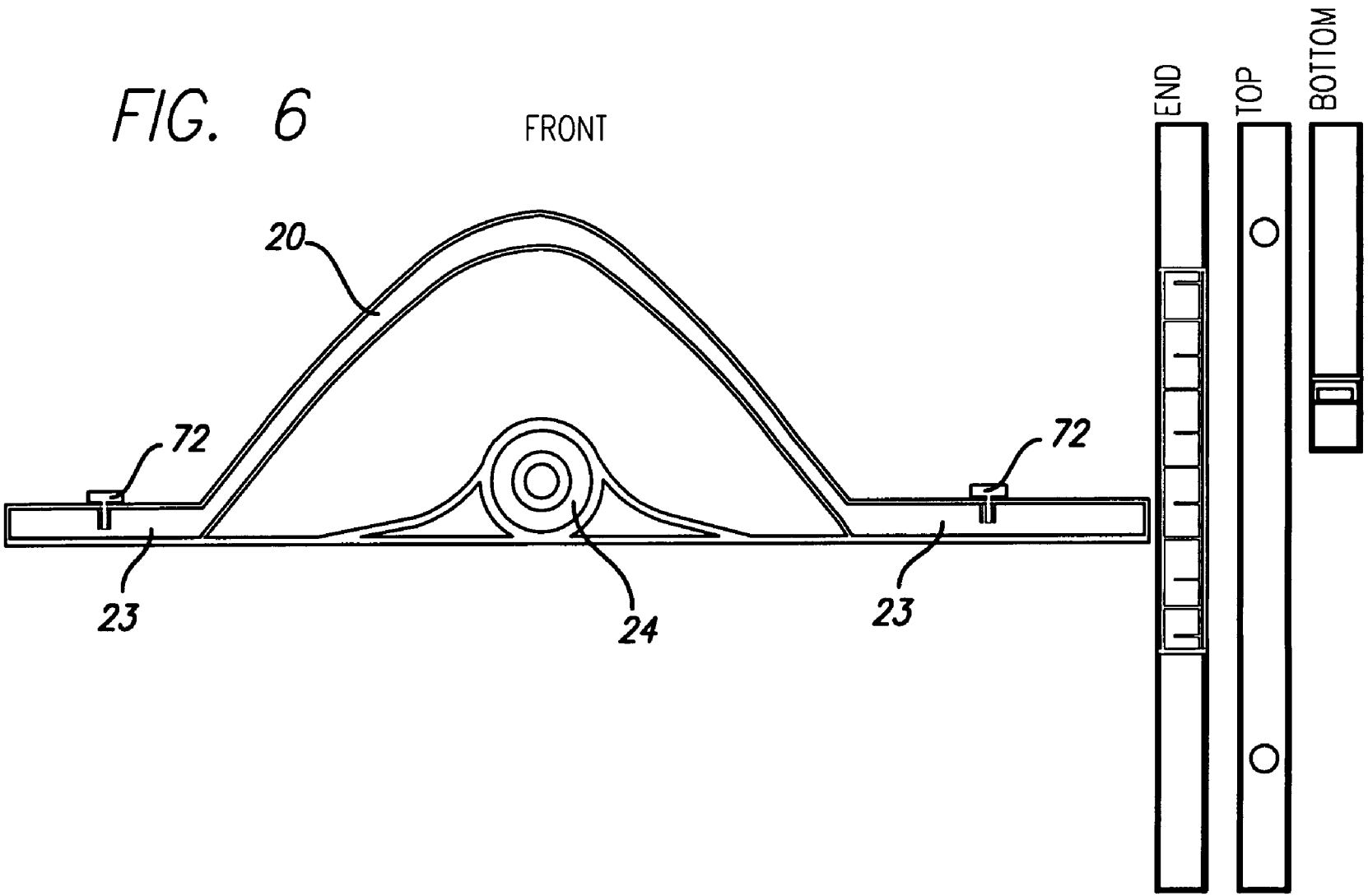
FIG. 6 shows front, end, top and bottom facing views of the annular arch of the training device of FIG. 1.
Figure 7:
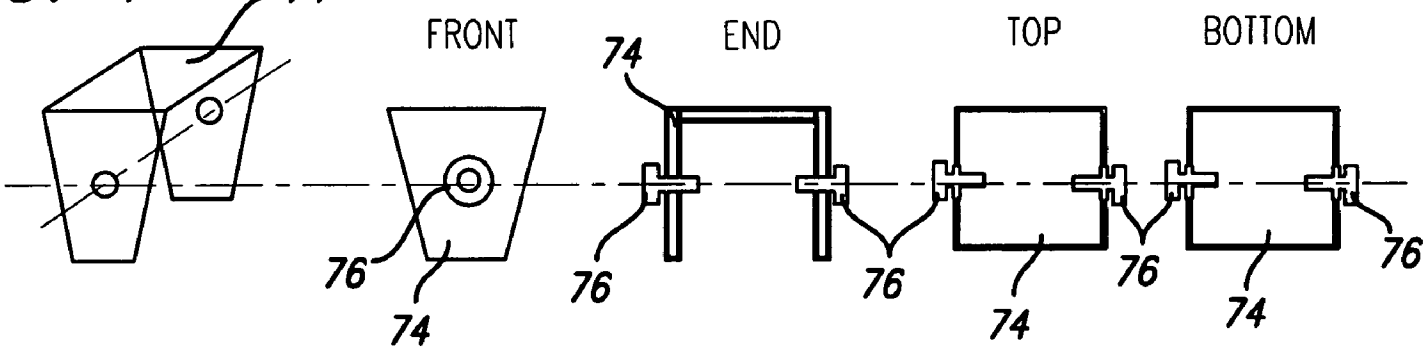
FIG. 7 shows front, end, top and bottom facing views of the arch clamp bracket of the training device of FIG. 1.

Referring to FIG. 6, the annular arch 20 of the training device 10 is shown in more detail. As previously described the annular arch 20 has an arch base 23 that is sized to fit within the base slotted track 14. In this position, the annular arch 20 is held rigidly in place on the device base 12 by mounting bolts 72. In one form, these bolts can be screwed into threaded holes in the device base 12. In a preferred form, they can be inserted from underneath the base 12 through the slotted track 14 and into threaded holes in the arch base 23, thereby allowing the position of the arch 20 to be varied along the track 14. In this form, the heads of the arch mounting bolts 72 also avoid interfering with the movement of the angular arm 16. The arch 20 also can be designed to have a height adjustment with respect to the base 12, thereby providing yet another variable input. This can be achieved by providing one or more a height adjustment screws in the arch base 23 that can be raised or lowered to set the height of the arch to the desired level. Appropriate linear scales can be incorporated to measure this height adjustment. Disposed on the arch base 23 is the arch hub 24, to which the swing arm 26 is mounted. Clamp brackets 74 can be mounted to the annular arch 20 for limiting the angular movement of the swing arm 26 by acting as stops on the annular arch 20. Referring to FIG. 7, the clamp bracket 74 is shown in more detail. Each clamp bracket 74 is a U-shaped bracket that is sized to fit over the annular arch 30. Set screws 76 inserted through a hole in each leg of the clamp bracket 74 can be tightened to engage the raised track 22 on the inside of the annular arch 20 and to hold the clamp bracket in place. Positioned on the outside of the annular arch 30 is a linear scale 78, which is similar in design to the linear scales that have previously been described. In this configuration, the position of each of the clamp brackets 74 can be continuously varied along the annular arch, thereby providing additional variable inputs for the catapult device 10, which variable inputs can be measured by the arch linear scale 78.

Figure 10:
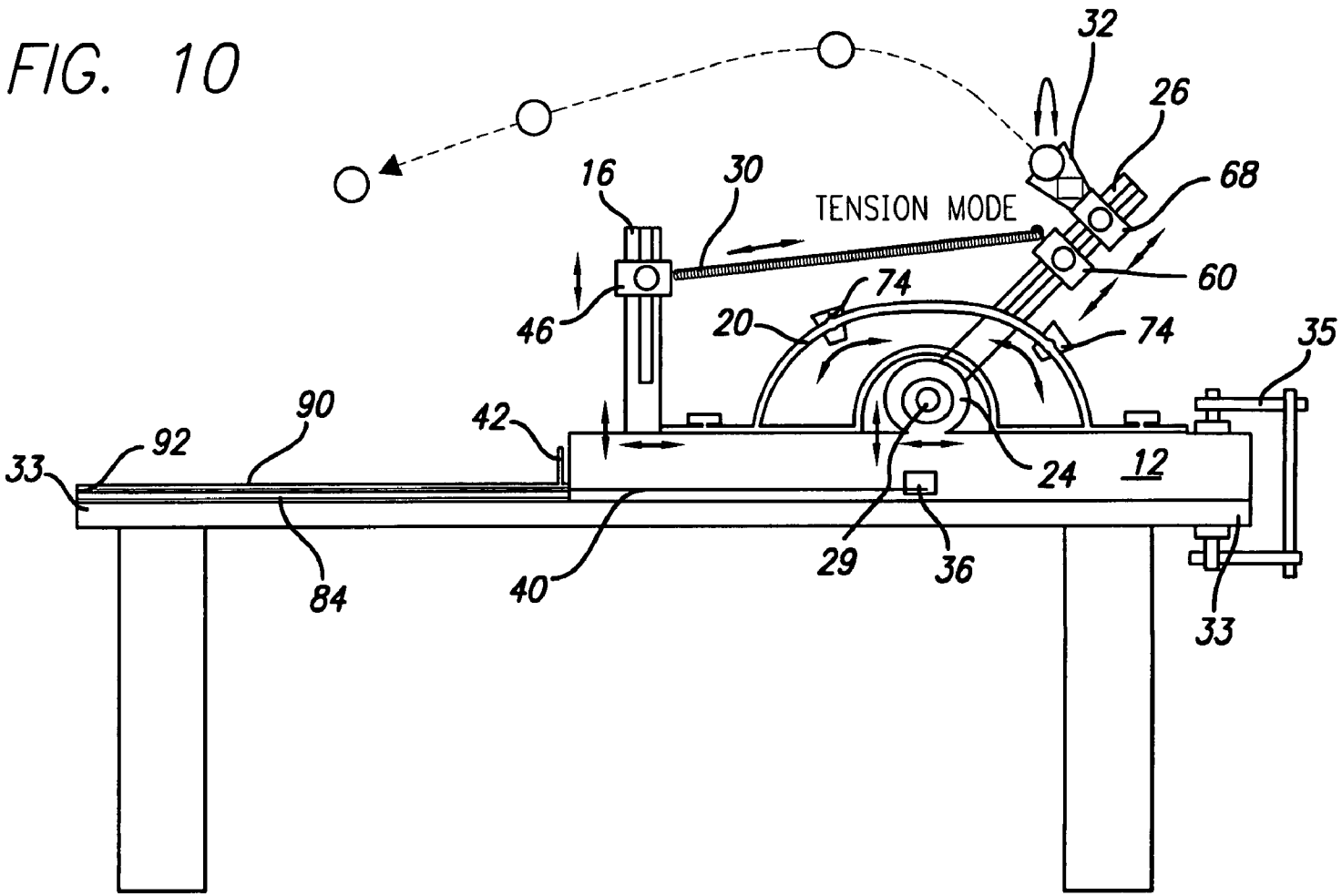
FIG. 10 is a front facing schematic view of the training device of FIG. 1 showing the device in operation and illustrating the input variables by two-way arrows.

FIG. 10 illustrates the training device of FIG. 1 in operation and illustrates by two-way arrows the adjustments that can be made to the device that represent input variables. As previously described and shown in FIG. 10, the configuration of the training device provides the instructor and user at least eleven possible variables from which to select (shown as two-way arrows on FIG. 10).

Referring to FIGS. 10, 12*a* and 12*b*, a graphical system for measuring the distance of a ball launched by the training device 10 is shown. This measurement system can eliminate the need for mechanical measuring tapes that have been used in the past to measure the distance of ball launches. The graphical measurement system includes a graph sheet 84 with appropriate linear distance graduations. Preferably, the graph sheet 84 includes a left graph portion 86 and right graph portion 88, which can be located on the table top 33 between 0 and 120 inches from the point of launch (considered the center of the base 12) with the right graph and left graph portions located on either side of a center line that aligns with the base slotted track 14. The graph sheet 84 can be placed under a sheet of carbon paper or other pressure sensitive sheet 90 to mark the impact of a launched ball. Preferably, a transparent sheet 92, such as a sheet of plastic film or transparent paper, is sandwiched between the graph sheet 84 and the pressure sheet 90. When the transparent sheet 92 becomes covered with pressure sheet markings that prevent its further use, it can be replaced by a fresh transparent sheet 92. The user only needs to replace the transparent sheet in those areas where the markings are densely located. The graphical measurement system also provides for the measurement of the angle of deviation from the center line of the graph sheet 84. The measurement of this angle provides another output for the user to characterize and optimize in the form of a mathematical model described as a function of the catapult training device input variables. The graphical measurement of output eliminates error in visual observation. The pressure paper positioning significantly minimizes error in output measurement. The transparent sheet 92 sandwiched between the graph sheet 84 and the pressure sheet 90 helps increase the life of the graph sheet. With this system, balls can have protrusions formed on their surface for making clearer marks on via the pressure sheet 90, resulting in higher accuracy and precision in measurements.

Figure 11:
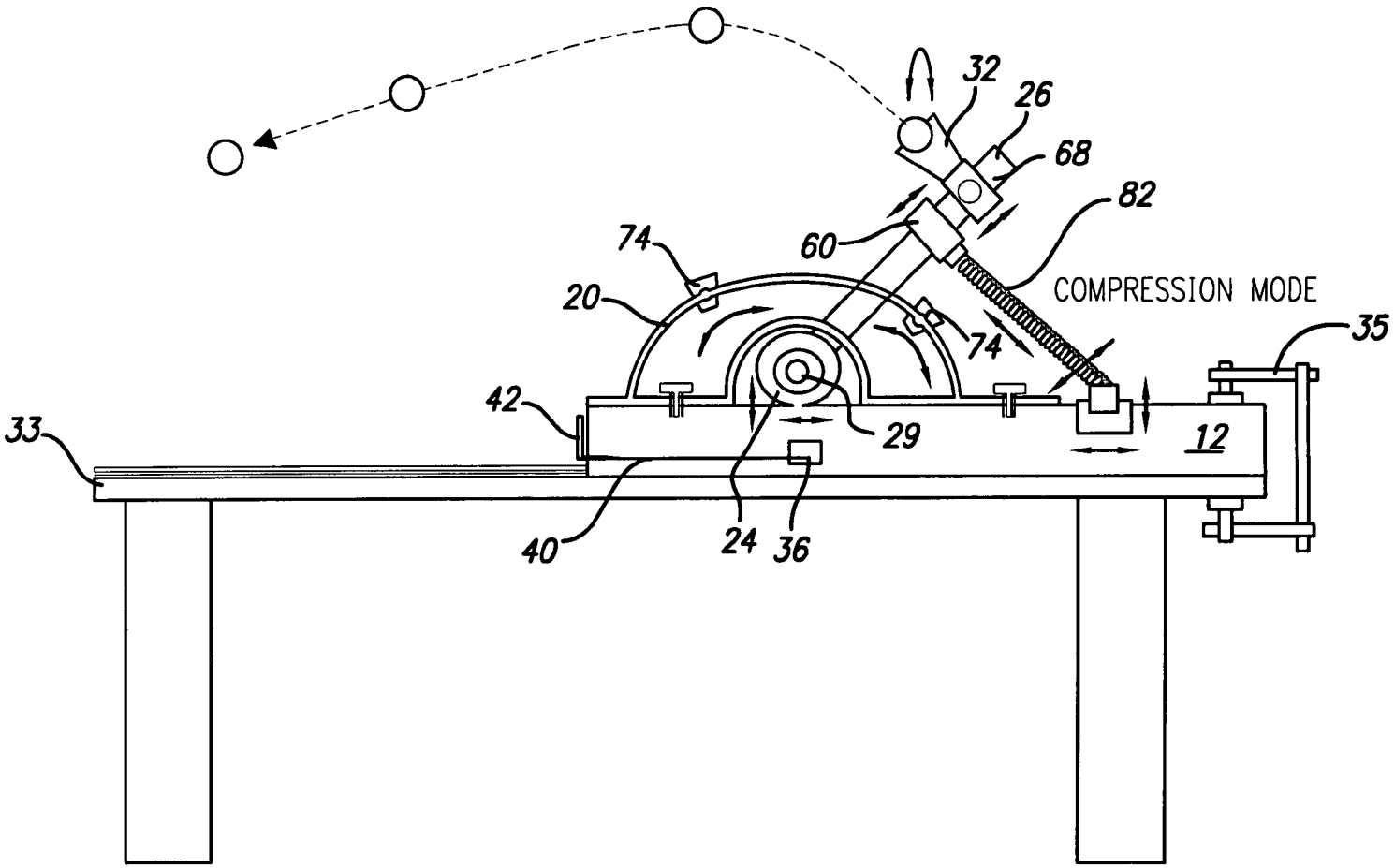
FIG. 11 is a front facing schematic view of another embodiment of a training device according to the invention, which device operates using a compression spring.

FIG. 11 shows an alternative preferred embodiment of a training device 10 according to the present invention. Referring to FIG. 11, the training device 10 includes a compression spring 82 for setting the swing arm 26 in motion, rather than a tension spring. The compression spring 82 has a cylindrical socket fixture 84 on one end for receiving the end of the spring. The socket 84 can be threaded so that the end of the spring 82 can be screwed into it. The socket fixture 84 can be constructed similar to known designs of flashlights wherein the batteries are held in place on the bottom by having spring coils helically screw into a threaded cap. The socket fixture 86 is attached to the swing arm bracket 60. A similar socket fixture 86 is attached to the other end of the spring 82 and is mounted to the base 12. For storage and transport, the compression spring 82 can be placed in a storage cylinder (not shown) that can be stored in the base recess 38.

In the configuration of FIG. 11, the linear arm 16, bracket 48 and tension spring 30 are not necessary. By providing these parts, however, the user can have the option of operating the training device 10 in the tension mode (see FIG. 10) or in the compression mode (see FIG. 11). To change the training device 10 from the tension mode to the compression mode, the user need only remove tension spring 30, remove the linear arm 16 from the base 12, and move the arch 20 forward in the base slotted track 14 toward the location where the linear arm 16 was mounted. The user then can attach the compression spring 82 as previously described. This choice of operating in compression mode allows the elimination of the linear arm 16 while providing the instructor and user at least eleven possible input variables from which to select (shown as two-way arrows on FIG. 11).

An alternative embodiment of the training device 10 can use a torsional, spring mechanism, similar to that found in an airline safety belt, which provides a rotational force about the arch hub 24. Such an embodiment eliminates the need for the linear arm 16. In addition, the arch 20 can be eliminated and additional hooks can be added to the swing arm 26 and base 12 to hold a string that measures the stop angle of the swing arm 26. A linear scale can be added to measure the starting angle position for the swing arm.

Figure 2:
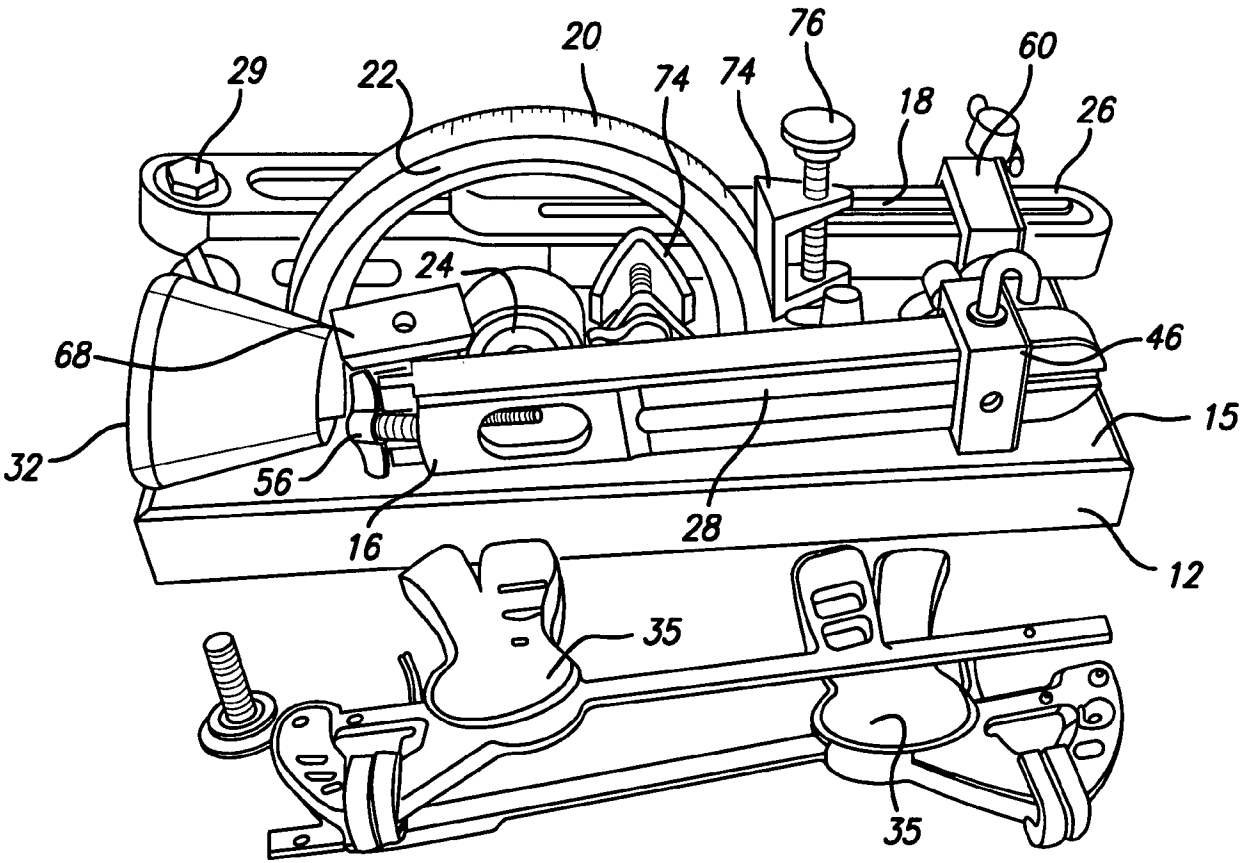
FIG. 2 is a perspective view of the device of FIG. 1 showing the device collapsed for disassembly and packed for ease of transportation.

The fundamental component parts of the training device according to the present invention can be made of plastic with higher strength-to-weight ratio than that of materials used in previously known devices. The training components can be manufactured either by machining or injection molding processes. The components can be assembled for operation of the training device 10 and disassembled for convenience of storage and portability. They can be of the snap-fit type or threaded type for assembly and operation. For the securing the components in a packed configuration (see FIG. 2), they can include securing means such as magnets, removable adhesive or Velcro.

Linear scales used for visual measurement of input variables can be universal. Different units of measurement or modes of input variables can be used. The device can be collapsed using Velcro patching for compact placement. Input and output data can be recorded manually, mechanically, or electronically. The device can be made out of metal, plastic or a combination for durability. Component parts can be made of material that is opaque or transparent for aesthetic appearance. A tape or pre-designed graph can measure the distance/angle output variable. A timer, such as an electronic timer or an integrated clock, can measure the output variable for cycle time. The linear arm can be moved based on the desired combination of input variables. The arch can be moved based on desired combination of input variables. The scales for unit of measurement can be separate or available in one universal system. Discrete input options can be offered through the design of the appropriate scales.

Advantageously, the system and method of the present invention can be used with an interactive system that supports e-learning and online remote instruction. The input and output data can be managed electronically. For example, scanner technology can be used to sense the setting of input variables. Rather than an impact sheet, membrane technology can be used to track the output variable data by recording the point of impact of balls launched by the device. The input and output data can than be transmitted to a user. A two-way digital signal processor can be used to acquire input and output data for receipt and transmission. Electronic data can exchanged wirelessly locally using a wireless technology such as Blutetooth technology or over the Internet using a PDA or other wireless device connected to the Internet.

To operate the training device 10, it must first be assembled. A preferred sequence of assembly of the components and set up of the device will now be described. Preferably, the device is used on a table top. The annular arch 20 is mounted to the base 12 by fitting the arch base 25 into the base slotted track 14 and securing it in place with the arch set screws 72. The linear arm 16 is mounted to the base 12 by fitting the tab 54 into the base slotted track 14 and securing it in place with the linear arm clamping screw 56. The user can then align the base 12 with the edge of the table top 33, as shown in FIGS. 1 and 10. The base 12 is clamped in this position using the C-clamps 35. The swing arm 26 is mounted to the annular arch 20 by sliding the annular arm fork 27 over the arch 20 and arch hub 24 and securing it in place with the hub bolt 29, washer and nut so that the swing arm 26 can pivot about the hub 24 and swing freely along the arch 20. The clamp brackets 74 are mounted to the arch 20, with one bracket 74 being mounted on each side of the swing arm 26. The linear arm bracket 46 is mounted to the linear arm 16 by sliding the bracket over the end of the arm 16 and tightening the set screw 48 and the swing arm bracket 60 is mounted to the swing arm 26 by sliding it over the end of the arm 26 and tightening the set screw 62. The ball cup 32 is mounted to the swing arm 26 by sliding the ball cup bracket 68 over the end of the swing arm 26 and tightening the set screw 70. The tension spring 30 is mounted between hooks 50, 64. After mounting the spring 30, the user can reposition the clamp brackets 74 to effectively set the points on the arch 20 for starting and stopping the swing of the swing arm 26. The assembled device 10 can then be used to launch balls. Launched balls can be retrieved manually, mechanically, or magnetically. Balls can be metal coated or magnetic for easy retrieval. A vertical reflector board (not shown) can be used for ball retrieval to minimize the number of operators and effort needed to retrieve the balls.

To launch balls with the assembled device 10, a user places the the graph sheet 84, a transparent sheet 92 and the pressure sheet 90 the with the right graph and left graph portions located on either side of a center line that aligns with the base slotted track 14, as described above. The user then places a ball in the ball cup 32 and pulls the swing arm 26 back toward the portion of the base 12 held by the C-clamps 35 until the swing arm 26 is stopped by the rear clamp bracket 74. When the user releases the swing arm 26, the tension spring 30 will pull the swing arm 26 forward and launch the ball. When the ball lands on the impact sheet 90, it will mark the transparent sheet 92 at the point of impact. The user can measure the point of impact using the graph sheet 84. It is then left to the choice of the user and instructor on how to manage the input variables to modify the launch of the ball and to collect data to create mathematical models. The input variables can be measured using FPI and/or SI Units of measurement and can be varied either discretely or continuously.

The output variables that can be monitored include the linear distance from the base 12, the angle of deviation either to the left or right of the center line of the base 12, and the cycle time conduct a given operation. The linear distance output variable can be measured using the integrated measuring tape 36 or the graphical measurement system previously described, which provides the user and instructor greater speed, accuracy and precision in comparison to the measuring tape 36.

The training device 10 can be disassembled as follows for convenient and compact storage in a storage box (not shown). The ball cup 32 can be loosened and removed from the swing arm 26, leaving the swing arm bracket 60 in place. The arch clamp brackets 74 can be loosened and moved apart on the arch 20, leaving them positioned on the arch 20. The spring 30 can be removed from the hooks 50, 64 and stored in the base recess 38 after the C-clamps 35 are removed. The swing arm 26 can be removed by loosening the hub bolt 29, washer and nut. The linear arm 16 can be removed from the base 12 by unscrewing the clamping screw 56. The annular arch 20 with clamp brackets 74 can be removed from the base 12 by unscrewing the arch screws 72. All of these components can be stored in the storage box along with balls used for launching.

Figure 14:
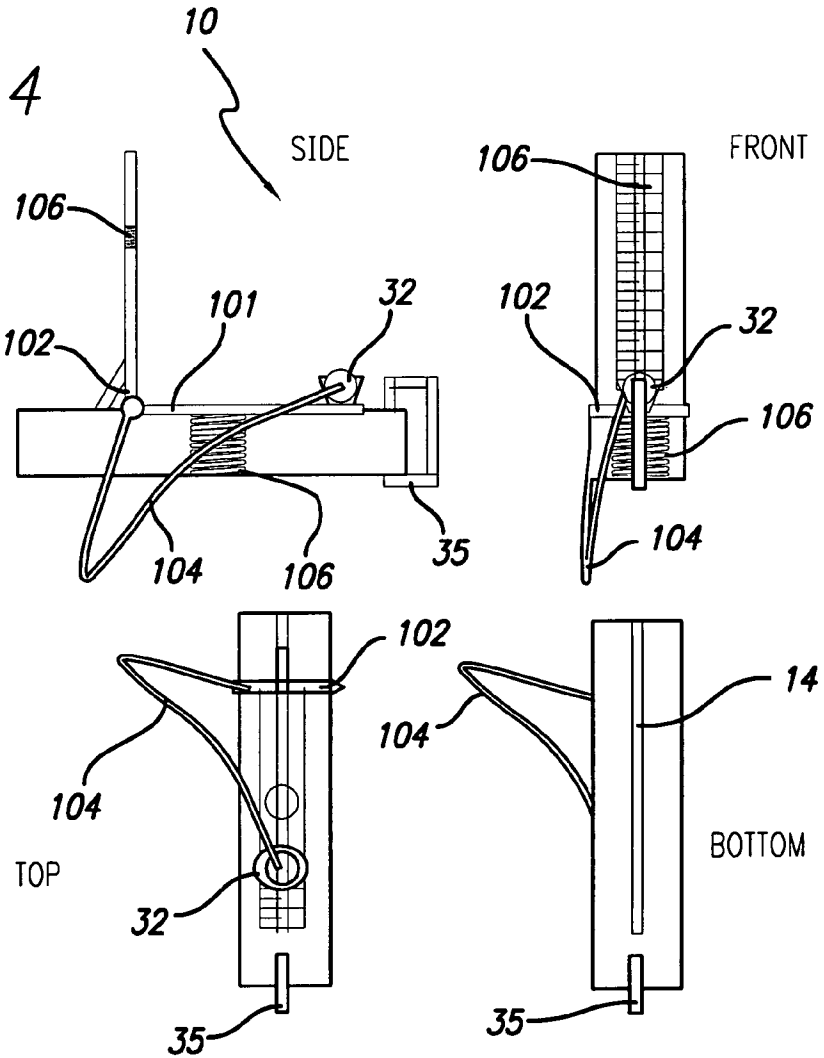
FIG. 14 shows the front, side, top and bottom facing views of the training device of FIG. 13.

Referring to FIGS. 13 and 14, another embodiment of a training device 10 according to the present invention can launch a ball that is easily retrievable at a desktop level. The device 10 includes an arm 101 that is mounted to the base 12 by a hinge 102. The ball cup 32 is mounted to the free end of the hinged arm 101. A spring 106 is disposed within the base 12 and presses against the hinged arm 101. A ball is tethered to the base by a tether 104, so there is no need to fetch the all each time it is launched. A user compresses the hinged arm 101 against the base 12 and releases the hinged arm 101 to launch the ball. When the ball is launched, it impacts an upright arm 106 mounted to the base. The training device 100 has variable inputs which will result in output variations, as shown in FIG. 13. It can be used as a tool for demonstrating the statistical tools and techniques. The device can be machined in plastic and is portable, collapsible, and easy to assemble and disassemble within minutes. It has relatively few parts and is easy to handle while operating.

As can be seen form the foregoing, the device according to the invention has numerous benefits over previously known devices. It is versatile and easy to use for both instructors and students. It provides a significantly higher number of controllable input variables than do previous devices, as well as multiple output variables, for simulating actual processes. It provides options for variable input or output technology based on the appropriate level of training. It provides options to address different skill levels of training for user and instructor in applied statistics. A user or instructor at a very basic level has the choice to either restrict the use of the system to meet his simple needs or utilize the available options for advanced learning and application. It can be set up in various configurations by removing or substituting certain components without changing the fundamental component parts. It can be used to demonstrate the effects of variables in any given process and is not limited to any specific industry or process application. It is versatile enough to demonstrate the advantages of incorporating continuous inputs technology and data transfer technology. The invention is applicable to and suits academic, industrial, government, military as well as nonprofit business operation type environments. With the device of my invention, training is faster and costs less time and manpower to operate. It makes true mathematical modeling possible.

The device of my invention also is easy to use and provides improved speed, ease, precision and accuracy of measurement. It utilizes an integrated, graphic input and output measurement system that reduces time and error in measuring time, angle and distance output variables. The system can use a combination of discrete, continuous, FPI and SI units of measurement by simply swapping appropriate linear scales. The system effectively eliminates the possibility of error in the setting of the input variables. The inputs and outputs can be managed manually or electronically. Management of the inputs and outputs electronically can allow for instruction and use of the training system by people with a limited mobility, hearing, sight, or our use of their hands. The electronic data management also can allow for avoiding mistakes in the input process, such as by using an alert system to warn the user in the event an input variable is in error, thereby eliminating the chance of an unwanted run or operating step. Recording the data electronically or through an automated measurement system, as opposed to reading it visually, also can help eliminate or reduce errors as well as the system operation time. Because it is easy to use, the device allows the user and instructor to manage in-class training activity with less manpower and without a group of trainees per system and trainees having to necessarily leave their desk for practical demonstration sessions.

The device of my invention is easy and inexpensive to manufacture and repair. It can be fabricated using automated machining processes, thereby eliminating the opportunities for variation due to operator skills. Its components can be constructed of durable, lightweight material that is resistant to wear. If a component is damaged, it can be replaced without the need of replacing the entire device. The device is easy to store and transport. It is lightweight and can be readily disassembled for storage and transportation.

The device is suitable for use in e-training or online training. Because input and output variable data can be managed electronically, e training can be achieved through Internet web hosting of the input and output variable data, either locally or remotely.

It will be understood by those of ordinary skill in the art that other arrangements and disposition of the aforesaid components, the descriptions of which are intended to be illustrative only and not limiting, may be made without departing from the spirit and scope of the invention, which must be identified and determined from the following claims and equivalents thereof.

I claim:

1. A catapult apparatus for teaching principles of problem solving using applied statistics, Six Sigma, lean manufacturing and other process excellence techniques, the apparatus comprising:

a base;

a hub fixed to a position with respect to the base and removable from the base;

a swing arm coupled to and rotatable about the hub from a first angle to a second angle;

a holder fixed to a position with respect to the swing arm and adapted to hold a projectile;

a spring coupled between a first coupling point fixed with respect to the base and a second coupling point on the swing arm;

means for continuously varying and measuring one or more of the first coupling point, the second coupling point, the first swing arm angle, the second swing arm angle, the hub position with respect to the base and the cup position with respect to the swing arm;

an arch member disposed about the hub; and one or more brackets adjustably mounted to the arch member to set one or more of the first angle and the second angle;

wherein the arch member has a base that fits within a slot in the catapult base.

2. A catapult apparatus for teaching principles of problem solving using applied statistics, Six Sigma, lean manufacturing and other process excellence techniques, the apparatus comprising:

a base;

a hub fixed to a position with respect to the base and removable from the base;

a swing arm coupled to and rotatable about the hub from a first angle to a second angle;

a holder fixed to a position with respect to the swing arm and adapted to hold a projectile;

a spring coupled between a first coupling point fixed with respect to the base and a second coupling point on the swing arm;

means for continuously varying and measuring one or more of the first coupling point, the second coupling point, the first swing arm angle, the second swing arm angle, the hub position with respect to the base and the cup position with respect to the swing arm;

an arch member disposed about the hub; and one or more brackets adjustably mounted to the arch member to set one or more of the first angle and the second angle;

wherein the arch member includes a height adjustment with respect to the catapult base.

3. A catapult apparatus for teaching principles of problem solving using applied statistics, Six Sigma, lean manufacturing and other process excellence techniques, the apparatus comprising:

a base;

a hub fixed to a position with respect to the base and removable from the base;

a swing arm coupled to and rotatable about the hub from a first angle to a second angle;

a holder fixed to a position with respect to the swing arm and adapted to hold a projectile;

a spring coupled between a first coupling point fixed with respect to the base and a second coupling point on the swing arm; and means for continuously varying and measuring one or more of the first coupling point, the second coupling point, the first swing arm angle, the second swing arm angle, the hub position with respect to the base and the cup position with respect to the swing arm;

wherein the first coupling point is disposed at a position on an arm fixed to the catapult base; and wherein the arm fits within a slot in the catapult base.

4. A catapult apparatus for teaching principles of problem solving using applied statistics, Six Sigma, lean manufacturing and other process excellence techniques, the apparatus comprising:

a base;

a hub fixed to a position with respect to the base, wherein the hub position with respect to the base is adjustable;

a swing arm coupled to and rotatable about the hub from a first angle to a second angle, wherein the first angle is adjustable;

a holder fixed to a position with respect to the swing arm and adapted to hold a projectile, wherein the holder position with respect to the swing arm is adjustable; and a spring coupled between a first coupling point fixed with respect to the base and a second coupling point on the swing arm;

wherein the hub position with respect to the base is adjustable through a continuous range of measurement.

5. A catapult apparatus for teaching principles of problem solving using applied statistics, Six Sigma, lean manufacturing and other process excellence techniques, the apparatus comprising:

a base;

a hub fixed to a position with respect to the base, wherein the hub position with respect to the base is adjustable;

a swing arm coupled to and rotatable about the hub from a first angle to a second angle, wherein the first angle is adjustable;

a holder fixed to a position with respect to the swing arm and adapted to hold a projectile, wherein the holder position with respect to the swing arm is adjustable; and a spring coupled between a first coupling point fixed with respect to the base and a second coupling point on the swing arm;

wherein the holder position with respect to the swing arm is adjustable through a continuous range of measurement.

6. A catapult apparatus for teaching principles of problem solving using applied statistics, Six Sigma, lean manufacturing and other process excellence techniques, the apparatus comprising:

a base;

a hub fixed to a position with respect to the base, wherein the hub position with respect to the base is adjustable;

a swing arm coupled to and rotatable about the hub from a first angle to a second angle, wherein the first angle is adjustable;

a holder fixed to a position with respect to the swing arm and adapted to hold a projectile, wherein the holder position with respect to the swing arm is adjustable; and a spring coupled between a first coupling point fixed with respect to the base and a second coupling point on the swing arm;

wherein the spring second coupling point on the swing arm is adjustable through a continuous range of measurement.

* * * * *